US006715834B1

(12) United States Patent
Liao

(10) Patent No.: US 6,715,834 B1
(45) Date of Patent: Apr. 6, 2004

(54) ANGLE ADJUSTING DEVICE FOR A CHAIR

(76) Inventor: Simon Liao, 6F-3, No. 27, Lane 61, Sec. 1, Kuang-Fu Rd., Sangchung City, Taipei Hsien (TW)

( * ) Notice: Subject to any disclaimer, the term of this patent is extended or adjusted under 35 U.S.C. 154(b) by 0 days.

(21) Appl. No.: 10/618,618

(22) Filed: Jul. 15, 2003

(51) Int. Cl.[7] ..... A47C 1/024
(52) U.S. Cl. ..... 297/362.13; 297/301.2
(58) Field of Search ..... 297/362.13, 301.2, 297/302.2, 300.3

(56) References Cited

U.S. PATENT DOCUMENTS 3,024,067 A * 3/1962 Brandoli ..... 297/362.13
3,807,796 A * 4/1974 Wirges ..... 297/362.13
4,370,001 A * 1/1983 Ornberg ..... 297/362.13
4,408,800 A * 10/1983 Knapp ..... 297/301.2
4,629,249 A * 12/1986 Yamaguchi ..... 297/300.3
4,916,968 A * 4/1990 Kabaya ..... 74/519
6,149,236 A * 11/2000 Brauning ..... 297/301.2

* cited by examiner

*Primary Examiner*—Peter R. Brown
*Assistant Examiner*—Joseph Edell
(74) *Attorney, Agent, or Firm*—Bacon & Thomas, PLLC

(57) ABSTRACT

An angle adjusting device for a chair includes a fixed plate, a pivotal plate being pivotable relative to the fixed plate, a cylinder secured in the fixed plate and having an actuating pin extending out and being movable relative to the cylinder, a control rod pivotal relative to the fixed plate, and a control plate driven by the control rod and having an extension in engagement with the actuating pin of the cylinder. Pivotal movement of the control rod drives the control plate to move to initiate movement of the actuating pin of the cylinder so that pressure inside the cylinder changes to allow the legs of the pivotal plate to move along the arcuate slot, which allows the pivotal plate to change its angle relative to the fixed plate.

3 Claims, 8 Drawing Sheets

ANGLE ADJUSTING DEVICE FOR A CHAIR

BACKGROUND OF THE INVENTION

1. Field of the Invention

The present invention relates to an angle adjusting device, and more particularly to an angle adjusting device for a chair to adjust the backrest angle relative to the seat.

2. Description of Related Art

With reference to FIG. 6, a conventional chair adjusting device (50) is adapted to be mounted between a seat (A) and a backrest (B) to allow the backrest (B) to change its angle relative to the seat (A).

With reference to FIGS. 7 and 8, the adjusting device (50) includes a fixed plate (51) adapted for engaging with the seat (A) of the chair and a moving plate (52) adapted for engaging with the backrest (B) of the chair. Furthermore, a U-shaped fixed frame (511) is fixed in the front portion of the fixed plate (51) and a U-shaped moving frame (512) is connected to the bottom of the moving plate (52). Two arcuate slots (513) are respectively and oppositely defined in a side face of the fixed frame (511) and two through holes (514) are also respectively and oppositely defined in the side face of the fixed frame (511) to receive therein a first pin (515) which extends into a mediate portion of the moving plate (52). A second pin (516) is received in the two arcuate slots (513) and is extended into the bottom portion of the moving plate (52). A post (518) has a first distal end securely connected to the fixed frame (511) and a second distal end securely connected to the second pin (516). A spring (517) is sandwiched between the fixed frame (511) and the moving frame (512).

When the conventional adjusting device is in application, that is, the operator is sitting on the chair and leaning on the backrest to apply a force to the moving plate (52), the moving plate (52) is pivoted about the first pin (515) and the bottom portion of the moving plate (52) moves along the arcuate slots (513) due to the second pin (516) being extended into the bottom portion of the moving plate (52) and received in the arcuate slots (513). Meanwhile, due to the movement of the bottom portion of the moving plate (52), the moving frame (512) moves toward the fixed frame (511), which compresses the spring (517) in a longitudinal direction of the post (518) to provide a damping effect to the force to the moving plate (52) so that the operator is able to slowly stretch out in a slanted position when the angle between the moving plate (52) and the fixed plate (511) becomes bigger and bigger.

However, the inclination of the moving plate (52) depends entirely on the force applied to the moving plate (52). That is, if the force applied to the moving plate (52) is removed, the moving plate (52) will be sprung back to its original position, which means that the adjusting device can not provide a positioning mechanism to maintain the position of the moving plate (52) relative to the fixed plate (511) and the operator will have to apply a force to the moving plate (52) every time the operator wants to have a relaxed sitting position.

In order to overcome the conventional drawback, a manufacturer introduced another kind of adjusting mechanism.

With reference to FIGS. 9 and 10, a different conventional adjusting device (60) is shown and has a fixed plate (61) adapted for engagement with the seat (A) of the chair and a moving plate (62) adapted for engagement with the backrest (B). The fixed plate (61) has an arcuate slot (611) defined in opposite sides of the fixed plate to receive therein a first pin (612) which extends into the bottom portion of the moving plate (62). A second pin (613) is provided to extend through the opposite sides of the fixed plate (61) and into a mediate portion of the moving plate (62) to allow the moving plate (62) to pivot relative to the fixed plate (61) using the second pin (613) as the pivotal center.

A shaft (613*a*) is pivotally connected to the first pin (612) and is extended through a housing (614) securely formed inside the fixed plate (61) and is mounted with a spring (615). Two limiting blocks (616) are also loosely mounted on the shaft (613*a*) and received in the housing (614) to be abutted by the spring (615) such that due to the abutment of the spring (615), one side face of each of the limiting blocks (616) is slanted inside the housing (614). A control rod (617) is extended from a side of the fixed plate (61) and into the housing (614). An extension (618) is axially formed on the control rod (617) to selectively engage with the side face of one of the limiting blocks (616). Therefore, when the operator is operating the control rod (617) to drive the extension (618) on the control rod (617) to engage with the side face of one of the limiting blocks (616) so as to render horizontal the slanted side face of the limiting block (616), the moving plate (62) is able to move relative to the fixed plate (61). When the angle of the moving plate (62) reaches a satisfactory position, the operator releases the control rod (617) to allow the side face of the limiting block (616) to be obliquely positioned again. Therefore, due to the slanted side face of the limiting block (616), the shaft (613*a*) is blocked from movement relative to the housing (614), which prevents the moving plate (62) from movement. Thus, the slanted angle of the moving plate (62) is maintained.

With the description above, it is noted that although the slanted angle of the moving plate (62) is able to be maintained, the complex and complicated structure make the manufacture cost high and repairs hard to carry out due to too many involved elements.

To overcome the shortcomings, the present invention tends to provide an improved angle adjusting device for a chair to mitigate the aforementioned problems.

SUMMARY OF THE INVENTION

The primary objective of the present invention is to provide an improved angle adjusting device for a chair, with which the manufacture cost is greatly reduced when compared with the conventional one.

Another objective of the present invention is to provide a cylinder inside the angle adjusting device to provide the damping effect required when the backrest is inclined relative to the seat.

Other objects, advantages and novel features of the invention will become more apparent from the following detailed description when taken in conjunction with the accompanying drawings.

DETAILED DESCRIPTION OF THE PREFERRED EMBODIMENT

Figure 1:
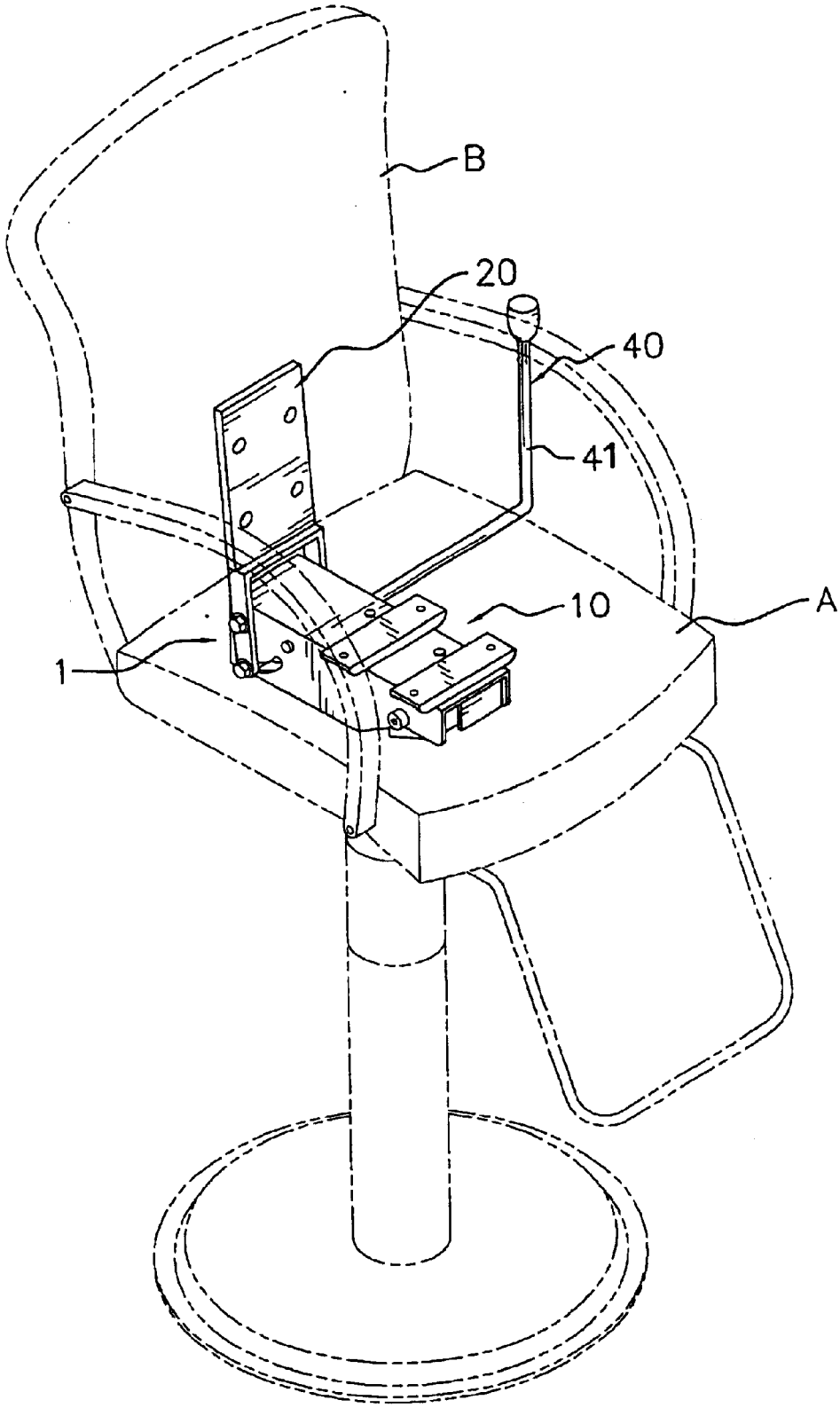
FIG. 1 is perspective view showing the angle adjusting device of the present invention.
Figure 2:
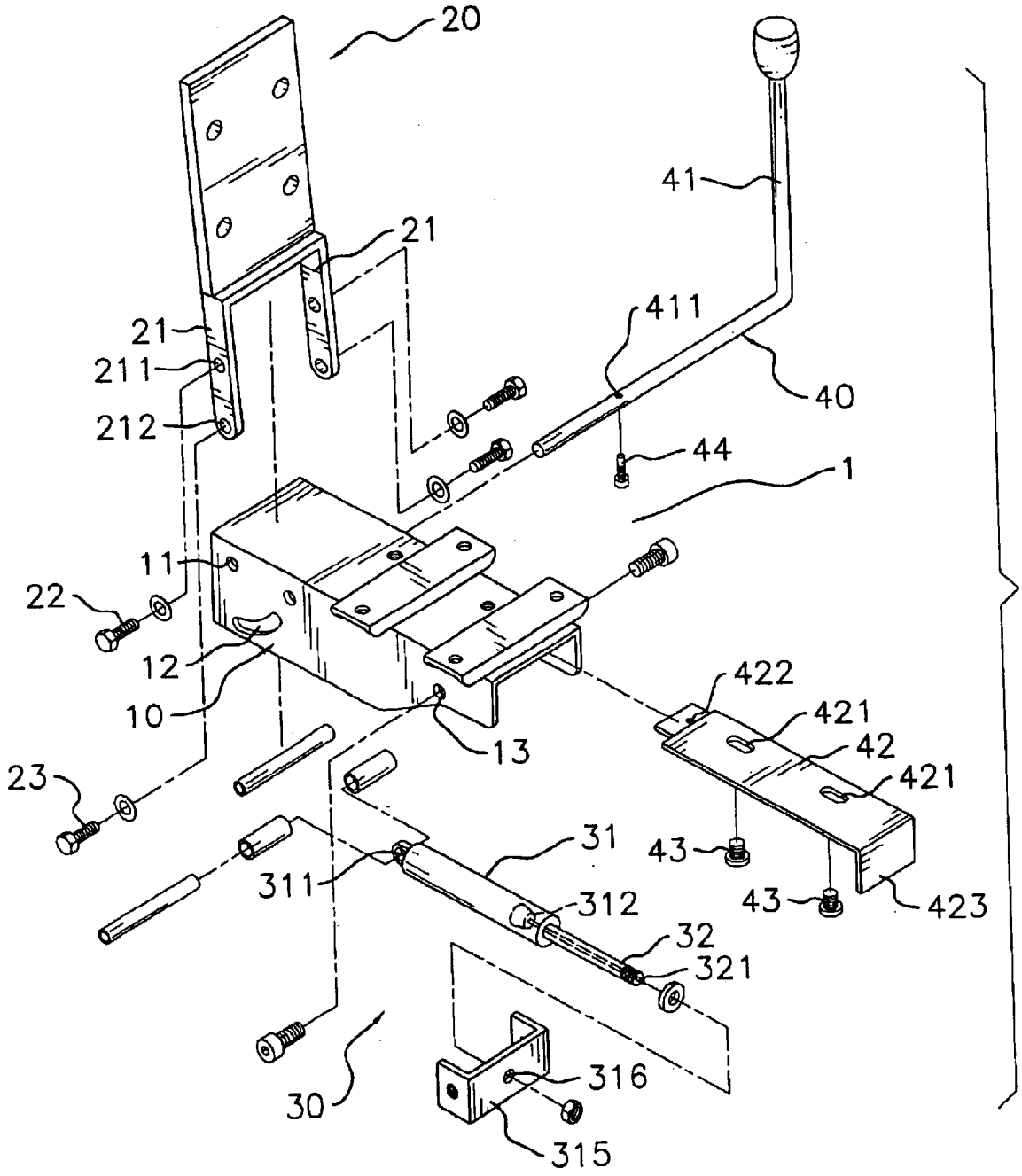
FIG. 2 is an exploded perspective view of the angle adjusting device of the present invention.

With reference to FIGS. 1 and 2, the angle adjusting device for a chair having a seat (A) and a backrest (B) movable relative to the seat (A) includes a fixed plate (10), a pivotal plate (20), a cylinder (30), and a control member (40).

The fixed plate (10) is adapted for engagement with the seat (A) of the chair and has a U shape cross section. The fixed plate (10) is provided with a pivot hole (11) formed on two side faces thereof, an arcuate slot (12) defined in two opposite side faces thereof and a mounting bole (13) defined in a front portion in the two opposite side faces thereof.

The pivotal plate (20) is adapted for engagement with the backrest (B) and has two legs (21) extending downward to the opposite side faces of the fixed plate (10) and each leg (21) has a first hole (211) corresponding to the pivot hole (11) and a second hole (212) corresponding to the arcuate slot (12).

The cylinder (30) includes a housing (31) with a third hole (311) in alignment with the second hole (212) and the arcuate slot (12), a shaft (32) movably received and extending out of the housing (31) and having an actuating pin (321) extending out from a free end of the shaft (32) to control pressure inside the housing (31). Because the internal structure and function of the cylinder (30) are conventional and well known in the art, detailed description thereof is thus omitted. However, the effect of the cylinder will be incorporated in the hereinafter description.

The control member (40) include a control rod (41) and a control plate (42) movable received in the fixed plate (10). The control plate (42) has at least one (two are shown in this preferred embodiment) long hole (421), a fourth hole (422) defined in a distal end of the control plate (42) and an extension (423) extending downward to engage with the actuating pin (321).

Figure 3:
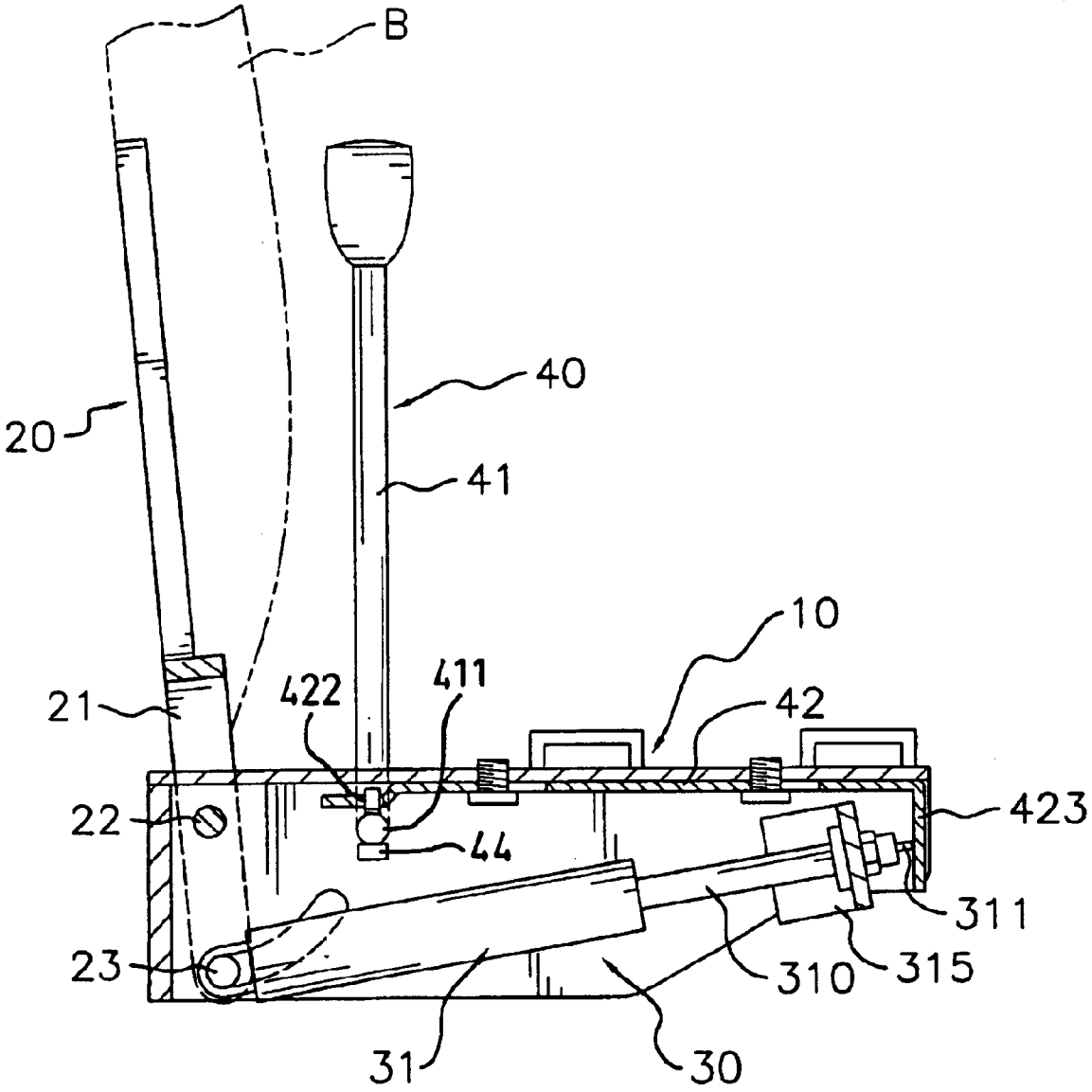
FIG. 3 is a schematic view showing the relative position between the angle adjusting device and the backrest and the seat of the chair.

With reference to FIG. 3 and still taking FIG. 2 for reference, when the adjusting device of the present invention is in assembly, the two legs (21) of the pivotal plate (20) are respectively arranged on opposite sides of the fixed plate (10) to have the first hole aligned with the pivot hole (11) and the second hole (212) aligned with the arcuate slot (12). A first pin (22) is inserted into the aligned first holes (21) and the pivot holes (11) to secure the engagement between the pivotal plate (20) and the fixed plate (10) and allow the pivotal plate (20) to be pivotable relative to the fixed plate (10). The cylinder (30) is then placed in the fixed plate (10) to have the third bole (311) of the cylinder (30) align with the arcuate slot (12) of the fixed plate (10). A second pin (23) is then inserted into and extended out of the second holes (212), the arcuate slots (12) and the third holes (311) to secure the cylinder (30) in the fixed plate (10).

A mounting frame (315) is securely mounted between two opposite side faces of the fixed plate (10) and includes an extension hole (316) defined to correspond to the shaft (32) of the cylinder (30). Therefore, after the shaft (32) of the cylinder (30) extends through the extension hole (316) of the mounting frame (315), the actuating pin (321) is extended out.

The control plate (42) is secured to a bottom face of the fixed plate (10) by at least one (two are shown in this preferred embodiment) bolt (43) extending through the long hole (421) and into the bottom face of the fixed plate (10) so that the extension (423) engages with the actuating pin (321) of the cylinder (30).

The control rod (41) has an axial hole (411) corresponding to the fourth hole (422) of the control plate (42) so that when a securing element (44), e.g. a bolt, is extended through the fourth hole (422) and into the axial hole (411) of the control rod (41), the rotation of the control rod (40) drives the control plate (42) to move. It is noted from FIG. 3 that the control rod (41) is an L-shaped rod and extended into the fixed plate (10) from the opposite side walls of the fixed plate (10).

Figure 4:
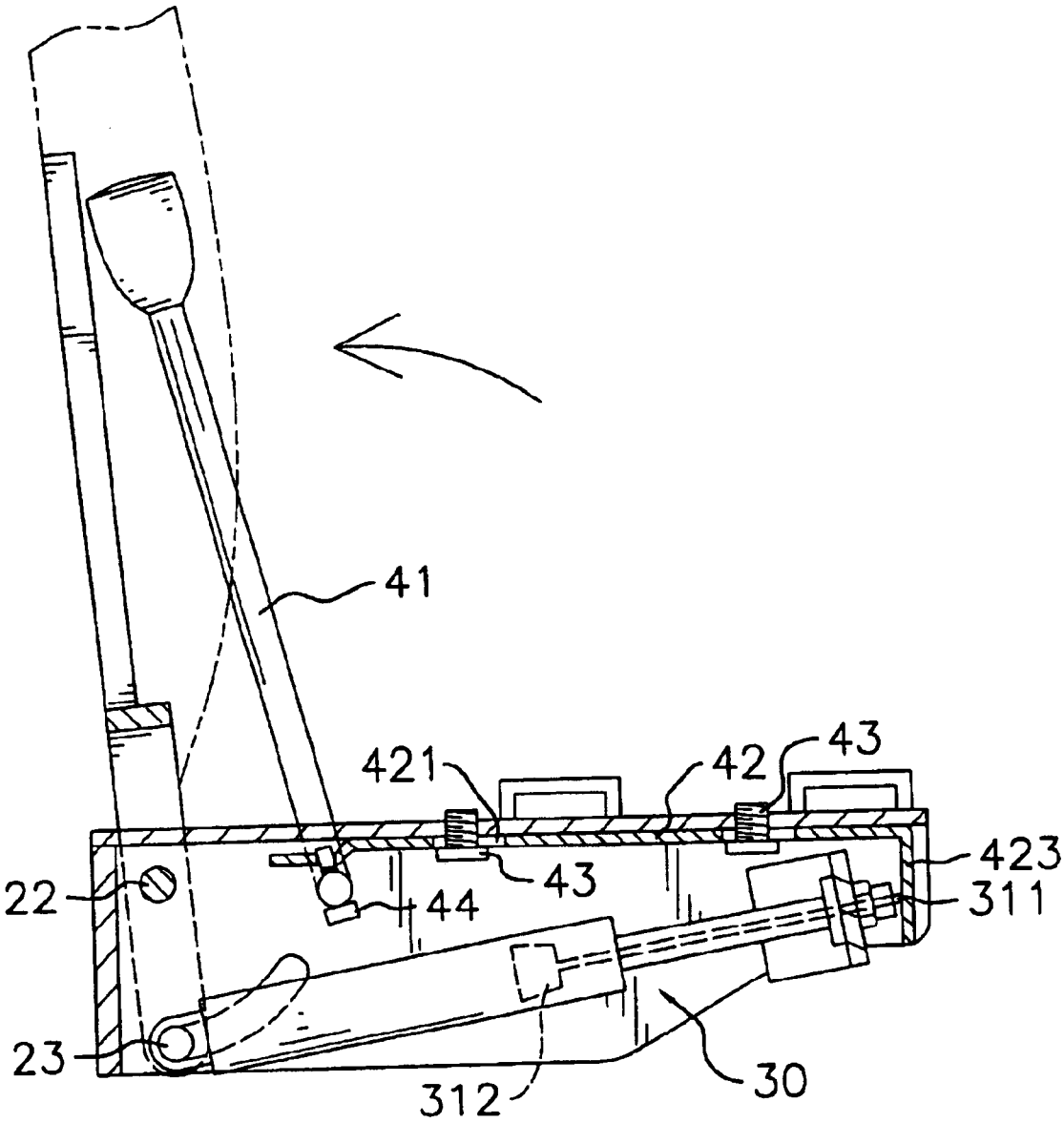
FIGS. 4 and 5 are side views showing the movement of the control rod and the resulting movement of the backrest relative to the seat.
Figure 5:
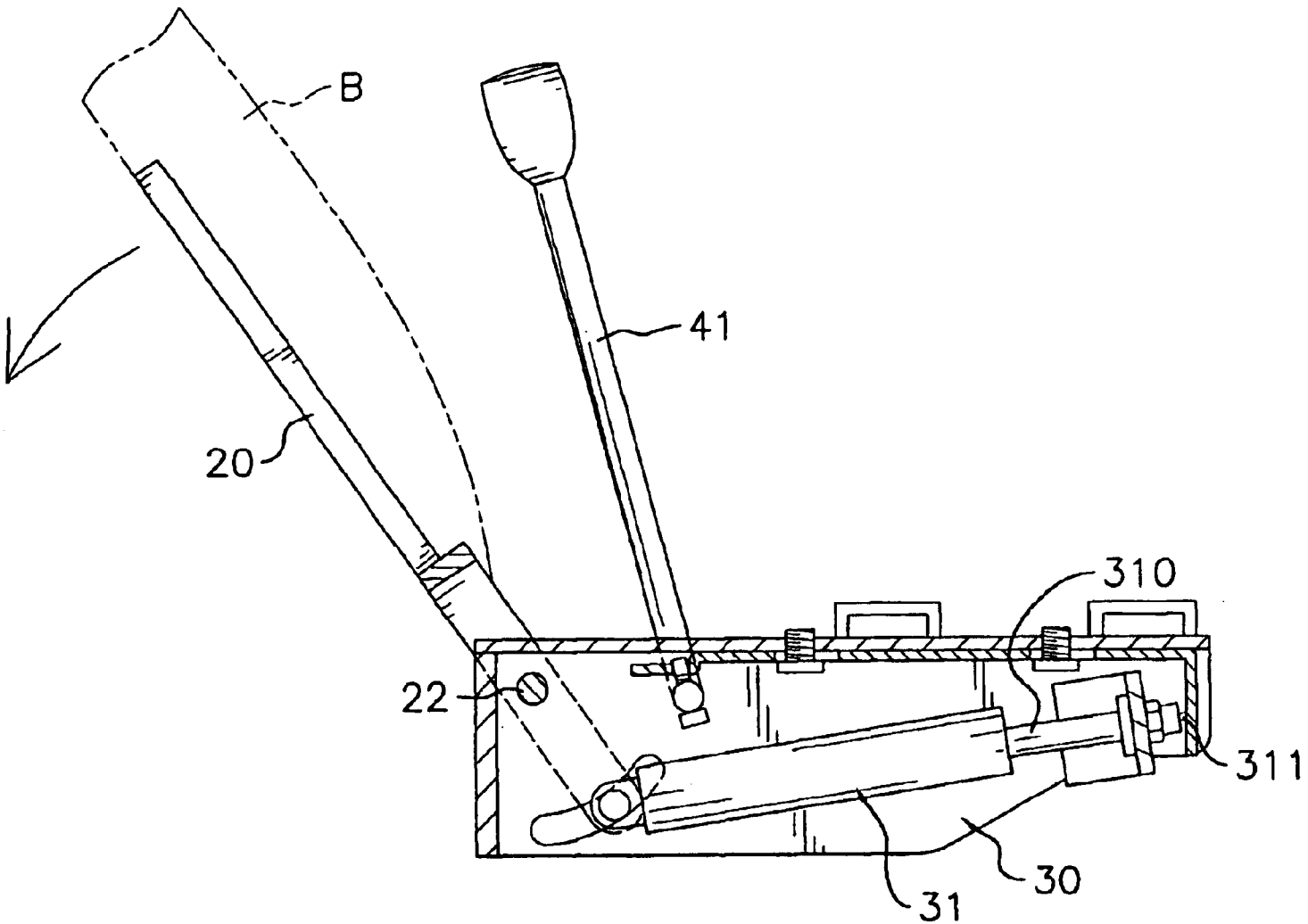
Figure 6:
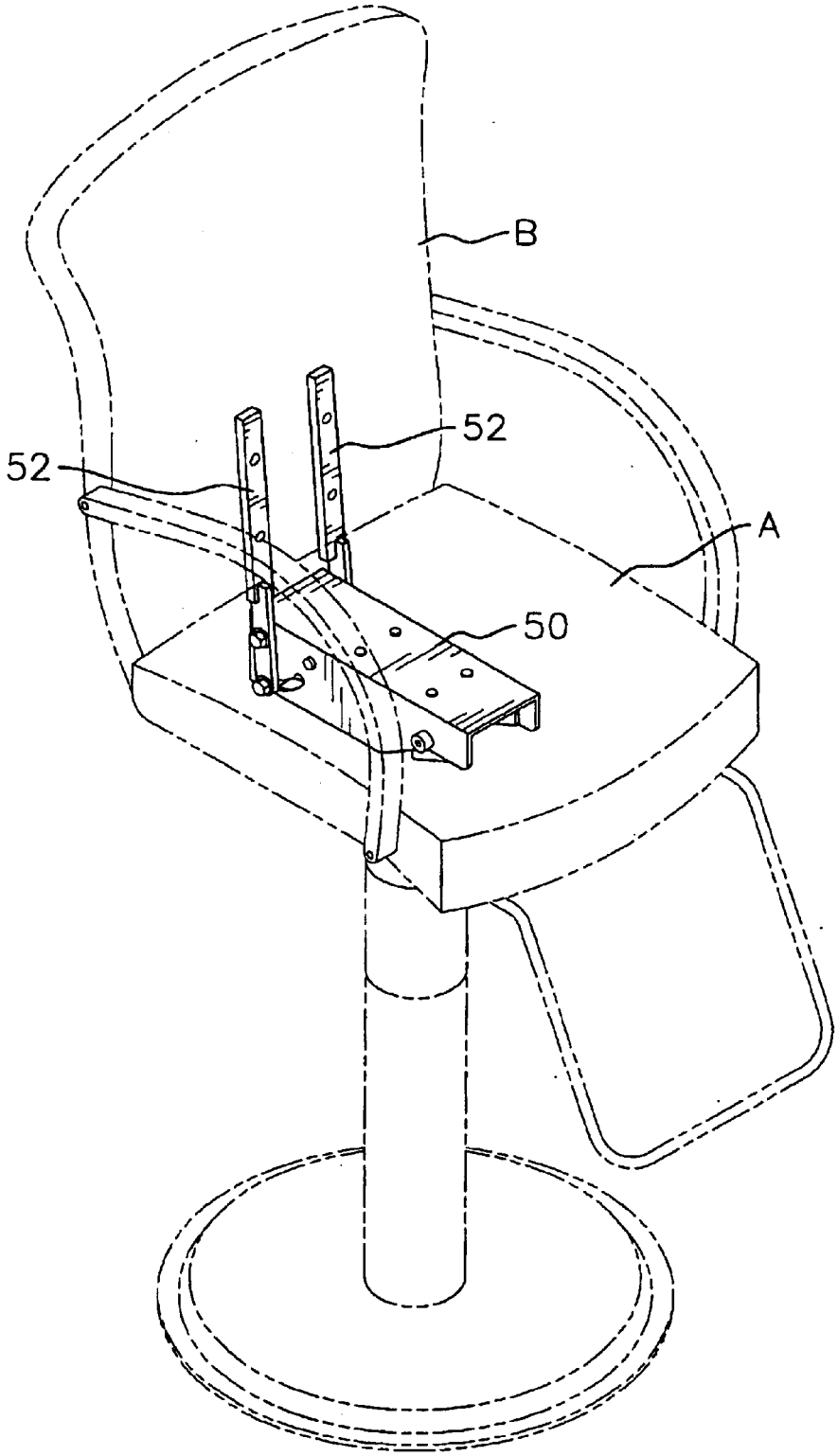
FIG.6 PRIOR ART
FIG. 6 is a perspective view showing a conventional adjusting device for a chair.
Figure 7:
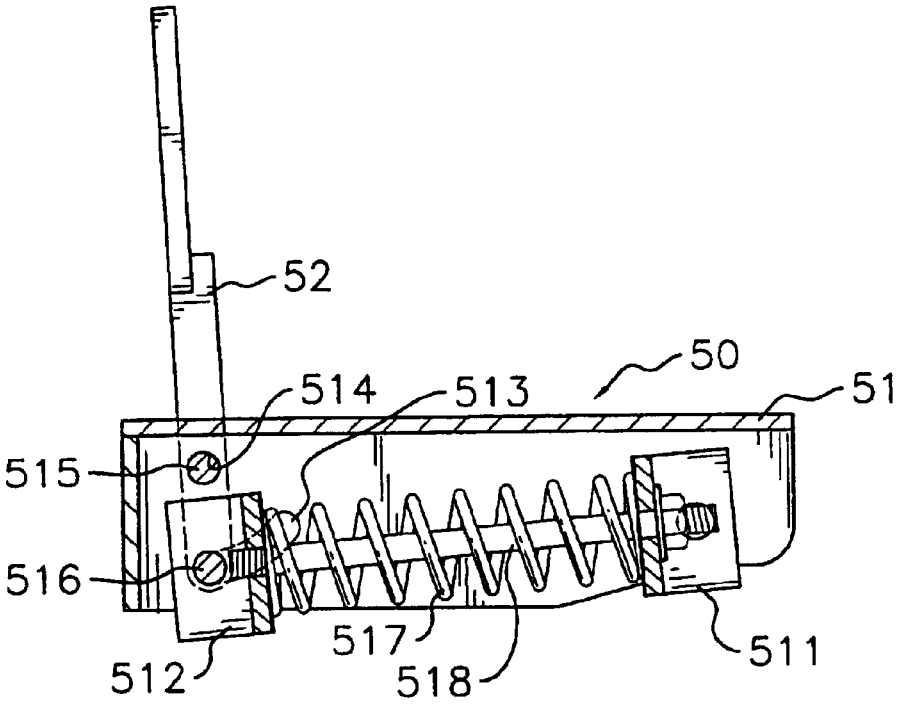
FIG.7 PRIOR ART
FIGS. 7 and 8 are schematic side views showing the interrelationship between the moving plate and the fixed plate in different states.
Figure 8:
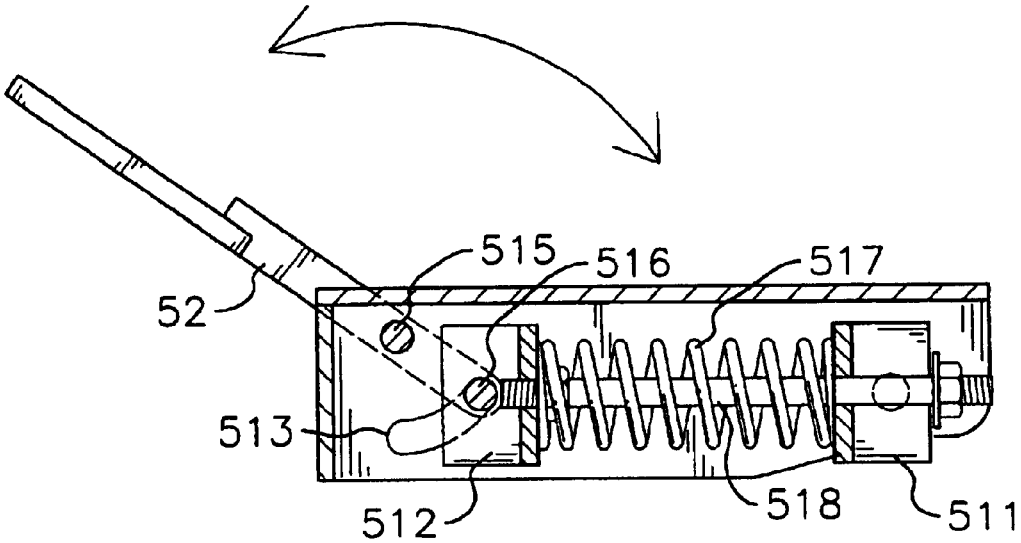
FIG.8 PRIOR ART
Figure 9:
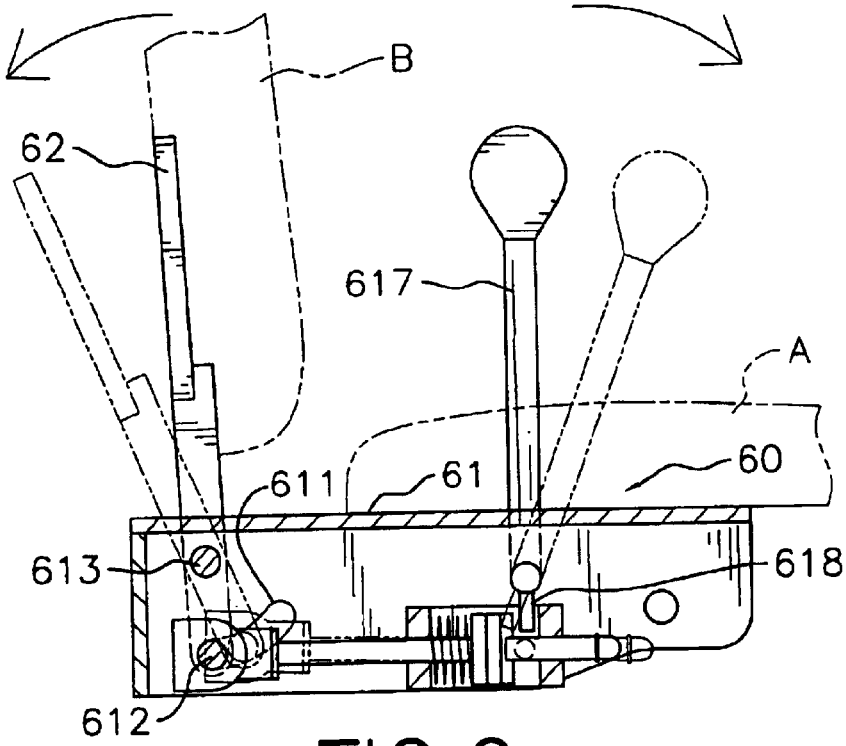
FIG.9 PRIOR ART
FIGS. 9 and 10 are schematic side views showing a different conventional adjusting device for a chair.
Figure 10:
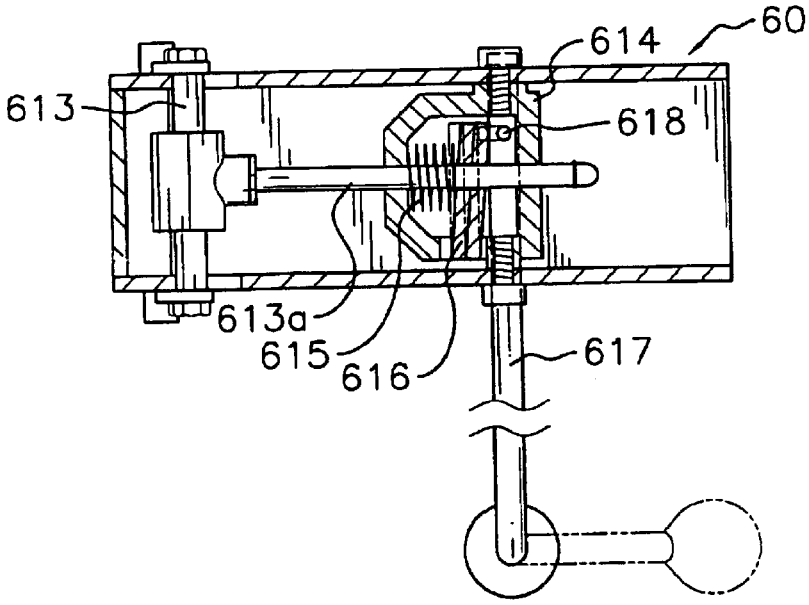
FIG.10 PRIOR ART

With reference to FIGS. 4 and 5, when the control rod (41) is pivoted toward the pivotal plate (20), the control plate (42) is driven to move toward the pivotal plate (20) as well. Due to the engagement of the control plate (42) with the actuating pin (321), pressure inside the cylinder (30) changes to allow the pivotal plate (20), under an applied force, to pivot. That is, the pivotal plate pivots about the first pin (22) in the first hole (211) and the bottom portion of the pivotal plate (20), especially the legs (21), is moved along the arcuate slots (12) of the fixed plate (10). Thereafter, the relative angle of the pivotal plate (20) and the fixed plate (10) is changed. After the inclination angle of the pivotal plate (20) has reached a satisfactory position, the operator releases the control rod (41). Because of the pressure inside the cylinder (30), the relative angle of the pivotal plate (20) to the fixed plate (10) is thus maintained. When the pivotal plate (20) is returned to its original position, the operator operates the control rod (41) again to decrease the pressure inside the cylinder (30), then the operator raises the pivotal plate (20) to resume its original position, which completes the angle adjustment process of the present invention.

It is to be noted that the structure of the present invention involves a simple transmission device to activate the pressure change in the cylinder such that the manufacture cost of the angle adjusting device is minimized. Furthermore, due to the minimum quantity of elements involved, the maintenance of the device is easy and inexpensive.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An angle adjusting device for a chair having a seat and a backrest pivotal relative to the seat, the angle adjusting device comprising:

a fixed plate adapted for engagement with the seat and having two pivot holes respectively defined in two opposite side faces in a rear portion thereof, two arcuate slots respectively defined in the two opposite side faces thereof and two mounting holes respectively defined in the two opposite side faces in a front portion thereof;

a pivotal plate adapted for engagement with the backrest and being pivotable relative to the fixed plate, the pivotal plate having two legs extending downward and each leg having a first hole in alignment with a respective one of the pivot holes and a second hole in alignment with a respective one of the arcuate slots such that after a first pin is inserted into the aligned first hole and the pivot holes and a second pin is inserted into the aligned second hole and the arcuate slots, the pivotal plate is able to pivot relative to the fixed plate;

a cylinder having a third hole defined in a first distal end of the cylinder and being in alignment with the arcuate slots so that the second pin is able to extend through the third hole to secure engagement of the cylinder with the fixed plate, a shaft received in and extending out of the cylinder and having an actuating pin extending out from a free end of the shaft;

a mounting frame securely received in the fixed plate and having an extension hole to allow the shaft of the cylinder to extend therethrough thereby position of the cylinder in the fixed plate is fixed;

a control rod extending through the opposite side faces of the fixed plate and being pivotal relative to the fixed plate; and a control plate driven by the control rod to be movable relative to the fixed plate and having an extension in engagement with the actuating pin of the cylinder, whereby pivotal movement of the control rod drives the control plate to move to initiate movement of the actuating pin of the cylinder so that pressure inside the cylinder changes to allow the legs of the pivotal plate to move along the arcuate slot, which allows the pivotal plate to change its angle relative to the fixed plate.

2. The angle adjusting device as claimed in claim 1, wherein the control rod has an axial hole and the control plate has a fourth hole in alignment with the axial hole so that after a securing element is inserted into the aligned axial hole and the fourth hole, the control rod and the control plate are securely combined and that the pivotal movement of the control rod is able to drive the control plate to move.

3. The angle adjusting device as claimed in claim 2, wherein the control plate has at least one long hole defined through a face thereof to allow a bolt to extend through the long hole and into a bottom face of the fixed plate to secure the control plate with respect to the fixed plate.

* * * * *